US010195893B2

(12) United States Patent
Pagan

(10) Patent No.: US 10,195,893 B2
(45) Date of Patent: Feb. 5, 2019

(54) PENCIL SHARPENER

(71) Applicant: Luis Javier Pagan, Dublin, OH (US)

(72) Inventor: Luis Javier Pagan, Dublin, OH (US)

(73) Assignee: Luis Javier Pagan, Dublin, OH (US)

( * ) Notice: Subject to any disclaimer, the term of this patent is extended or adjusted under 35 U.S.C. 154(b) by 0 days.

(21) Appl. No.: 15/602,317

(22) Filed: May 23, 2017

(65) Prior Publication Data

US 2017/0253072 A1 Sep. 7, 2017

Related U.S. Application Data

(63) Continuation-in-part of application No. 14/860,929, filed on Sep. 22, 2015, now Pat. No. 9,656,510.

(60) Provisional application No. 62/078,690, filed on Nov. 12, 2014.

(51) Int. Cl.

| | |
|---|---|
| ***B43K 29/06*** | (2006.01) |
| ***B43L 23/06*** | (2006.01) |
| ***B43K 19/02*** | (2006.01) |
| ***B43K 29/00*** | (2006.01) |

(52) U.S. Cl.

CPC ..... *B43K 29/06* (2013.01); *B43K 19/02* (2013.01); *B43K 29/004* (2013.01); *B43L 23/06* (2013.01)

(58) Field of Classification Search

CPC ..... B43K 29/06; B43K 29/00; B43K 29/18; B43K 19/02; B43K 29/004; B43L 23/06; B43L 23/08; B43L 23/085; B43L 23/00

See application file for complete search history.

(56) References Cited

U.S. PATENT DOCUMENTS

| | | | |
|---|---|---|---|
| 465,057 | A | 12/1891 | Foley |
| 562,303 | A | 6/1896 | Kaiser |
| 627,279 | A | 6/1899 | Stassart |
| 965,235 | A | 7/1910 | Selleck |
| 1,200,575 | A | 10/1916 | Barrows |
| 1,214,996 | A | 2/1917 | Boye |
| 1,327,038 | A | 1/1920 | Hamilton |
| 1,382,047 | A | 6/1921 | Allsworth |
| 1,719,976 | A | 7/1929 | Grimmer |
| 1,849,914 | A | 3/1932 | Delvin |
| 2,069,619 | A | 2/1937 | Mendelson |
| 2,333,714 | A | 11/1943 | Fletcher |
| 2,507,089 | A | 5/1950 | Bridges |

(Continued)

FOREIGN PATENT DOCUMENTS

| | | | |
|---|---|---|---|
| CH | 302058 | A | 9/1954 |
| DE | 857915 | C | 12/1952 |

(Continued)

*Primary Examiner* — David Walczak

(74) *Attorney, Agent, or Firm* — Renner, Otto, Boisselle & Sklar, LLP

(57) ABSTRACT

A pencil sharpener may include a body having a first end and a second end aligned along a main axis of the body, the body having a pencil receptacle disposed at the first end and configured to releasably attach to a pencil such that a longitudinal axis of the pencil is parallel to the main axis of the body of the pencil sharpener, the body further having a bore formed therein between the first end and the second end, the bore having a bore axis oblique to the main axis; and a sharpener blade disposed adjacent the bore such that a portion of a pencil is insertable into the bore of the body to be sharpened by the sharpener blade.

20 Claims, 6 Drawing Sheets

(56) References Cited

U.S. PATENT DOCUMENTS

| | | | | |
|---|---|---|---|---|
| 2,512,208 | A | 6/1950 | Kuper | |
| 2,680,426 | A | 6/1954 | Kohut | |
| 2,708,905 | A * | 5/1955 | Randall | B43K 25/00 24/11 CC |
| 2,757,638 | A | 8/1956 | Goldstein | |
| 3,039,436 | A | 6/1962 | Exner | |
| 3,399,945 | A | 9/1968 | Gouget | |
| 3,850,531 | A | 11/1974 | Ackermann | |
| 3,980,114 | A * | 9/1976 | Maniscalki | B43K 25/026 30/457 |
| 4,459,056 | A | 7/1984 | Getgey et al. | |
| 4,755,074 | A | 7/1988 | Roberts | |
| 5,205,664 | A | 4/1993 | Yushan et al. | |
| 5,599,123 | A | 2/1997 | Still | |
| D402,314 | S | 12/1998 | Lidle et al. | |
| D411,236 | S | 6/1999 | Maldonado | |
| 6,257,789 | B1 | 7/2001 | Podszuweit et al. | |
| 6,830,404 | B2 | 12/2004 | Nagaoka | |
| 6,854,913 | B2 | 2/2005 | Farrell et al. | |
| 7,143,516 | B2 | 12/2006 | Sterios | |
| 7,458,947 | B2 | 12/2008 | Farrell et al. | |
| 7,500,322 | B2 | 3/2009 | Brown | |
| D598,497 | S | 8/2009 | Koch et al. | |
| 7,601,130 | B2 | 10/2009 | Farrell et al. | |
| D608,895 | S | 1/2010 | Farrell et al. | |
| 7,832,108 | B2 | 11/2010 | Sterios-Primiani | |
| 7,892,194 | B2 | 2/2011 | Farrell et al. | |
| 8,328,743 | B2 | 12/2012 | Farrell et al. | |
| 8,328,744 | B2 | 12/2012 | Farrell et al. | |
| 2011/0179655 | A1 | 7/2011 | Lemieux | |

FOREIGN PATENT DOCUMENTS

| | | | |
|---|---|---|---|
| EP | 1034943 | A1 | 9/2000 |
| EP | 1034943 | B1 | 7/2003 |
| FR | 1029451 | A | 6/1953 |
| FR | 2846912 | A1 | 5/2004 |
| GB | 679264 | A1 | 9/1952 |

* cited by examiner

PENCIL SHARPENER

FIELD OF THE INVENTION

The present disclosure relates generally to writing devices such as conventional and mechanical pencils. More particularly, the present disclosure relates to a pencil sharpener.

BACKGROUND

Pencils, particularly conventional pencils but also some types of mechanical pencils, need sharpen to write sharply and neatly. Before the development of dedicated pencil sharpeners, a pencil was sharpened by whittling it with a knife. Pencil sharpeners made this task much easier and gave a more uniform result than a knife. A pencil sharpener sharpens a pencil's writing point by shaving away its surface.

The first American pencil sharpener was patented by Walter K. Foster of Bangor, Me. in 1855. They now come in a wide array of colors and shapes.

Manual sharpeners have no moving parts and consist of a combined point-shaping cone that is aligned to the cylindrical pencil alignment guide hole, into which the pencil is inserted. A sharp blade is mounted so that its sharp edge just enters the shaping cone. The pencil is inserted into the sharpener and rotated while the sharpener is held motionless. The body of the sharpener is often contoured, ridged or grooved to make the small block easier to firmly grip.

The blade inside the sharpener shaves the wood and tip of the pencil, while the shavings emerge through a slot along the blade edge. It may be important that the cylindrical alignment hole closely fit the diameter of the pencil to keep the pencil from wobbling; causing stepped or lurching cut-depths and point breakage.

Conventionally, pencil sharpeners were independent of the pencil, requiring users to search for sharpeners when a pencil needs sharpening. This may be inconvenient. In addition, used pencils reaching certain lengths were considered unusable for being too short and became discarded. This is wasteful. The present invention integrates a pencil sharpener and a writing device such as a pencil so as to increase convenience for the users and reduce waste by utilizing portions of pencils that were thought to be unusable.

SUMMARY OF THE INVENTION

This disclosure provides a writing device that has a pencil sharpener built in within its body. A bore is formed within the body of the writing device and a sharpener blade attaches to the body in relationship to the bore. A user may insert the pencil's tip into the bore and sharpen it by rotating the pencil. The sharpener blade shaves the wood and core tip of the pencil, while the shavings emerge from a groove arranged at a side of the writing device. The inner surface of the bore keeps the pencil steady relative to the writing device while being sharpened.

In one embodiment, the writing device includes a tip at one end, a dome at the other end or both that are conductive and electrically or capacitively connected to a coating of the writing device. Therefore, when a user holds the writing device, the user may use the tip at one end, the dome at the other end or both as a stylus to be used as input device for touchscreen-enabled devices.

This disclosure further provides a pencil sharpener that is releasably attachable to a pencil. The pencil may be released from the pencil sharpener such that the pencil, released from the pencil sharpener, may be sharpened using the pencil sharpener.

These and further features of the present invention will be described with reference to the attached drawings. In the description and drawings, particular embodiments of the invention have been disclosed in detail as being indicative of some of the ways in which the principles of the invention may be employed, but it is understood that the invention is not limited correspondingly in scope. Rather, the invention includes all changes, modifications and equivalents coming within the terms of the appended claims.

BRIEF DESCRIPTION OF THE DRAWINGS

The accompanying drawings, which are incorporated in and constitute a part of the specification, illustrate various example systems, methods, and so on, that illustrate various example embodiments of aspects of the invention. It will be appreciated that the illustrated element boundaries (e.g., boxes, groups of boxes, or other shapes) in the figures represent one example of the boundaries. One of ordinary skill in the art will appreciate that one element may be designed as multiple elements or that multiple elements may be designed as one element. An element shown as an internal component of another element may be implemented as an external component and vice versa. Furthermore, elements may not be drawn to scale.

DETAILED DESCRIPTION

Figure 4:
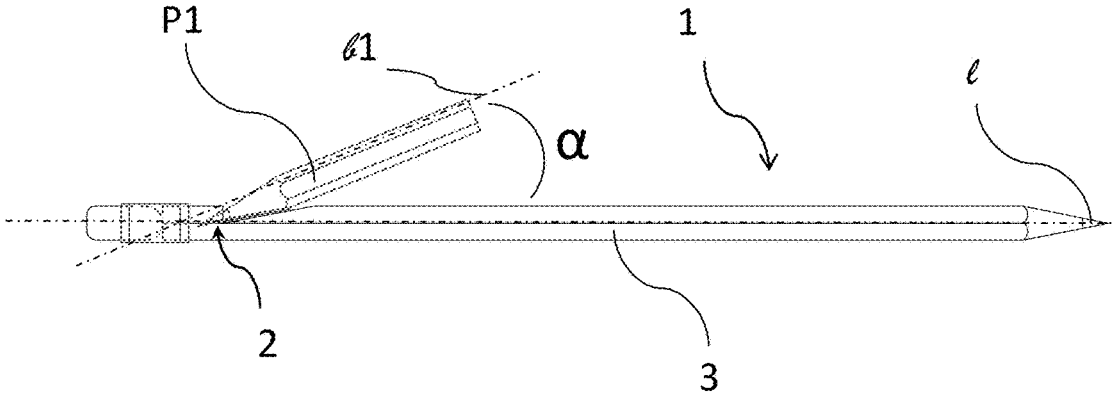
FIG. 4 illustrates a side view of an exemplary writing device with a pencil being sharpened using the pencil sharpener built within the body of the writing device.

FIGS. 1-5 illustrate an exemplary writing device 1. The writing device 1 has a pencil sharpener 2 built into its body 3. This way, as shown in FIG. 4, a user may sharpen a pencil P1 using the sharpener 2 built into the writing device 1. Although the illustrated writing device 1 is shown as resembling a conventional pencil in the drawings, the writing device 1 may resemble writing devices other than a conventional pencil such as a pen, a mechanical pencil, etc.

Figure 1:
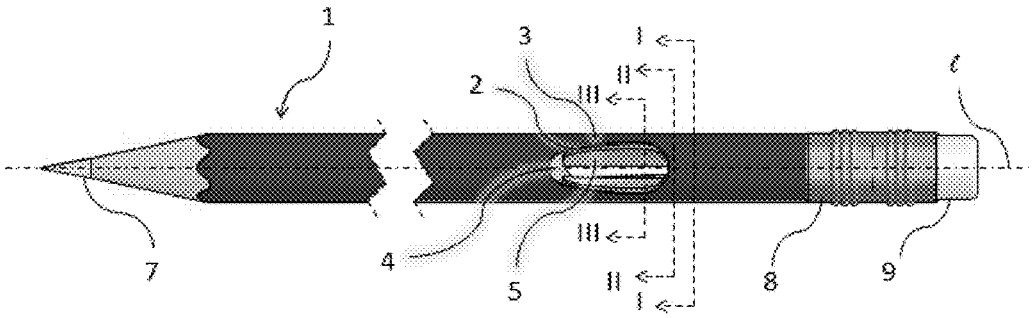
FIG. 1 illustrates a top view of an exemplary writing device.
Figures 1A, 1B, 1C:
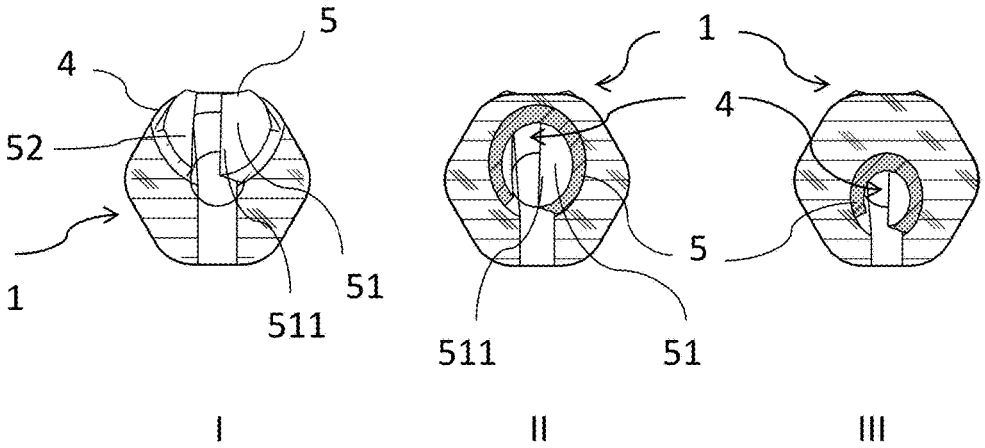
FIGS. 1A-C illustrate sectional views of the writing device with a sharpener built therein.
Figure 2:
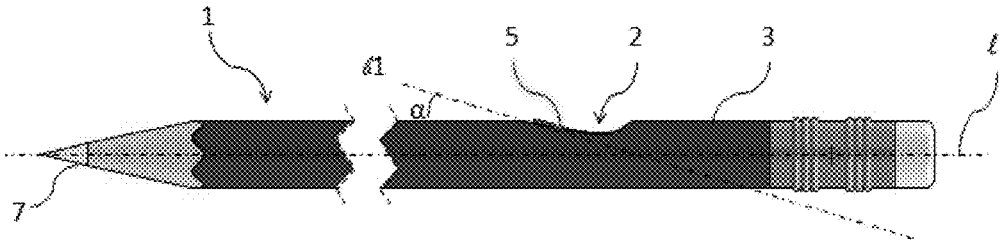
FIG. 2 illustrates a front view of the exemplary writing device.
Figure 3:
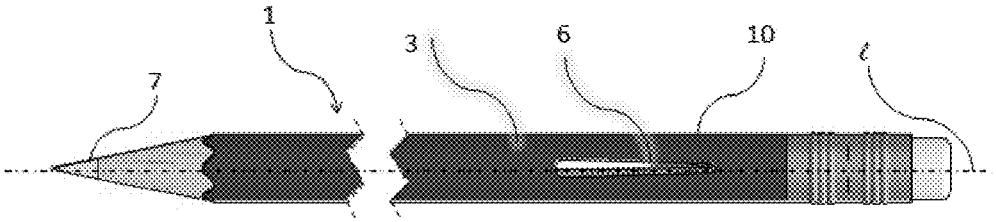
FIG. 3 illustrates a bottom view of the exemplary writing device.

The writing device 1 has a bore 4 formed in the body 3. The bore 4 is in a shape of a modified cone. As shown in FIGS. 2 and 4, the bore 4 is formed in the body 3 at an oblique angle $\alpha$ relative to a main axis I of the writing device 1. In other words, the bore 4 has a bore axis b1 (i.e., the axis of the modified cone) that is oblique to the main axis I. The angle $\alpha$ may be from 5° to 85°.

The writing device 1 also includes a sharpener blade 5 that is operatively attached to the body 3 at least partially within the bore 4. The writing device 1 further includes a groove 6 on a surface of the writing device 1. The groove 6 allows sharpener shavings to exit.

A user may insert the tip of the pencil P1 into the bore 4 and sharpen the tip by rotating the pencil P. The sharpener blade 5 shaves the wood and core tip of the pencil P1 while the shavings emerge from the groove 6. The inner surfaces of the bore 4 keep the pencil P1 steady relative to the writing device 1 while being sharpened.

In the illustrated embodiment, the writing device 1 is a pencil and thus the writing device 1 includes a solid pigment core 7 (i.e., graphite) disposed inside the body 3 along or parallel the main axis I. In other embodiments, the writing device 1 is a writing device other than a pencil (e.g., pen, mechanical pencil, etc.) or a pencil that has a solid pigment core other than graphite (an example of which is disclosed in detail below) disposed inside the body 3 along or parallel the main axis I.

Figure 6A:
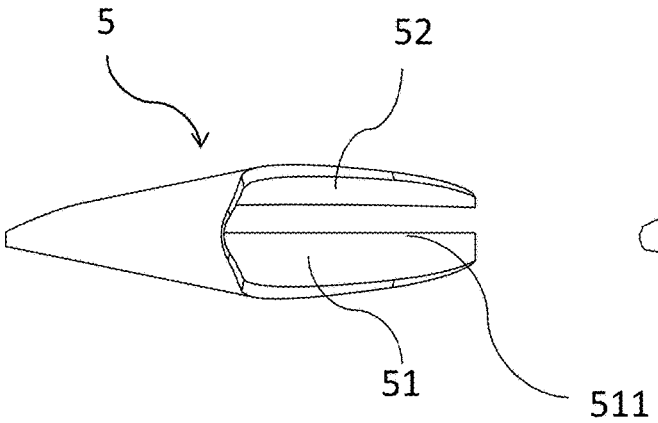
FIG. 6A illustrates a magnified top view of the exemplary sharpener blade.
Figure 6B:
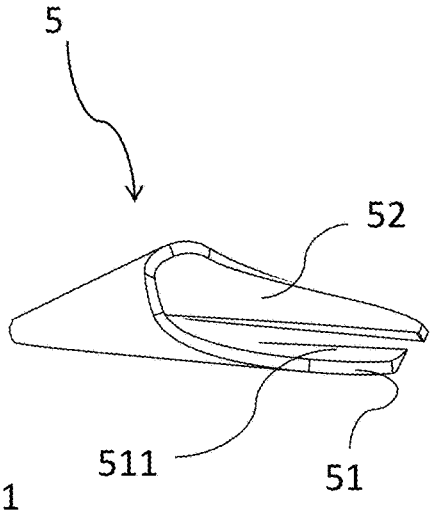
FIG. 6B illustrates a magnified perspective view of the exemplary sharpener blade.
Figure 6C:
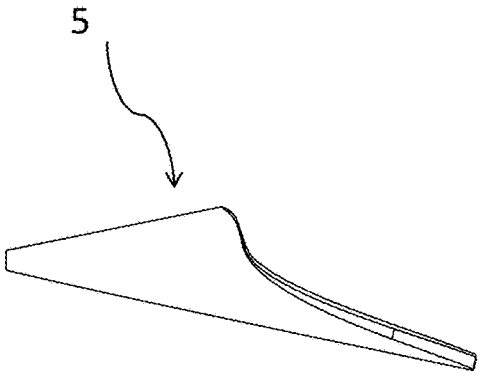
FIG. 6C illustrates a magnified front view of the exemplary sharpener blade.
Figure 6D:
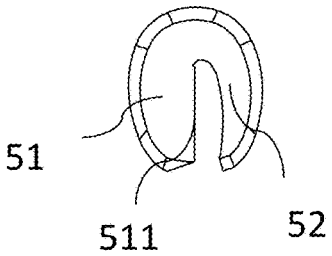
FIG. 6D illustrates a magnified side view of the exemplary sharpener blade.

As illustrated in FIGS. 6A-6C, the sharpener blade 5 is in a shape of a modified oblique cone and has two arms 51, 52 extending from one end of the sharpener blade 5 rearward away from the vertex of the cone. The two arms 51, 52 extend in parallel to each other with a space in between. One arm 51 has a flat surface on which the pencil P1 to be sharpened lies and the flat surface has a sharpening edge 511 for sharpening a pencil. The other arm is configured to guide sharpening of the pencil P1 and maintain stability for the pencil P1 when the pencil P1 is being sharpened.

Figure 5:
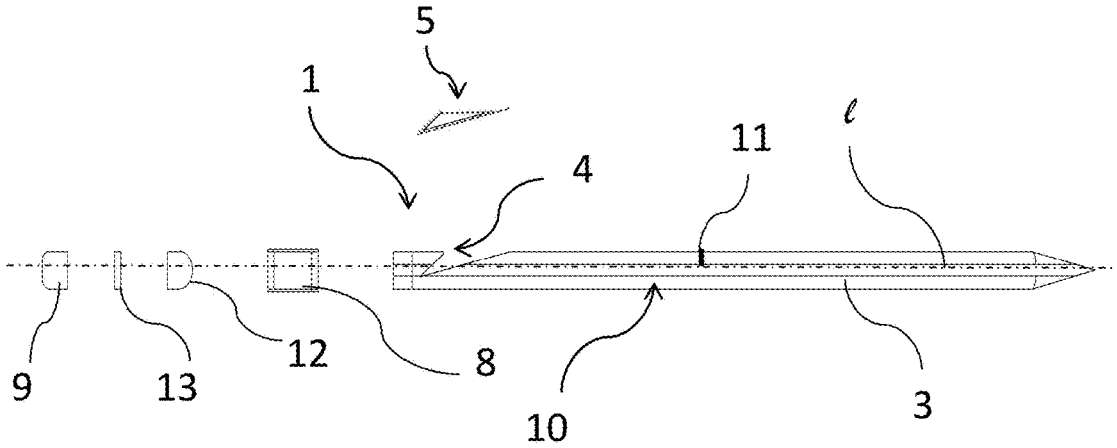
FIG. 5 illustrates an exploded view of the exemplary writing device.

In the illustrated embodiment and as best shown in the exploded view of FIG. 5, the writing device 1 also includes a collar 8 mounted at one end of the body 3. The collar 8 has a first opening that mounts to or receives the body 3. The writing device 1 may also include an eraser 9. In the illustrated embodiment, the collar 8 has a second opening that receives the eraser 9. This way, the eraser 9 may be attached to the writing device 1. In one embodiment, the writing device 1 does not include the collar 8 and/or the eraser 9 may be mounted to the writing device 1 by means (e.g., adhesive) other than the collar 8.

In one embodiment, the writing device 1 includes an electrically conductive layer 10 (e.g., sprayed on metal, film, etc.) that coats at least some of the exterior of the body 3. In one embodiment, the solid pigment core 7 of the writing device 1 may also be electrically conductive (e.g., metal-infused graphite, etc.) and may be electrically or capacitively connected to the electrically conductive layer 10. The solid pigment core 7 may be electrically or capacitively connected to the electrically conductive layer 10 via a metallic connection 11 (shown in FIG. 5). When a user holds the writing device 1 with his hand, electrical or capacitive contact between the user's hand and the tip of the core 7 allows the user to use the writing device 1 as a thin stylus that can be used as input device for touchscreen-enabled devices.

In one embodiment, the writing device 1 includes an electrically conductive elastomeric dome 12 best shown in FIG. 5. The collar 8 may receive the dome 12 in its second opening to attach it to the writing device 1. The dome 12 may be electrically or capacitively connected to the electrically conductive layer 10. When a user holds the writing device 1 with his hand, electrical or capacitive contact between the user's hand and the dome 12 allows the user to use the writing device 1 as a thick stylus that can be used as input device for touchscreen-enabled devices.

Thus, the writing device 1 may be used as a thin or a thick stylus depending on the user's needs.

In the illustrated embodiment of FIG. 5, the writing device 1 includes both the eraser 9 and the dome 12. In such an embodiment, the writing device 1 may include a magnet 13 attached to each of the eraser 9 and the dome 12. The collar 8 may be made of a magnetic material such that the assembly formed by the eraser 9, the dome 12 and the magnet 13 may be retained within the second opening of the collar 8 by the magnetic connection between the magnet 13 and the collar 8. A user may pull the assembly formed by the eraser 9, the dome 12 and the magnet 13 from the second opening of the collar 8 by breaking the magnetic force between the magnet 13 and the collar 8. This way, the user may reversibly choose whether to use the eraser 9 or the dome 12. In this embodiment, the electrical or capacitive connection between the dome 12 and the electrically conductive layer 10 of the writing device 1 may be provided through the collar 8 and the magnet 13.

Figure 7:
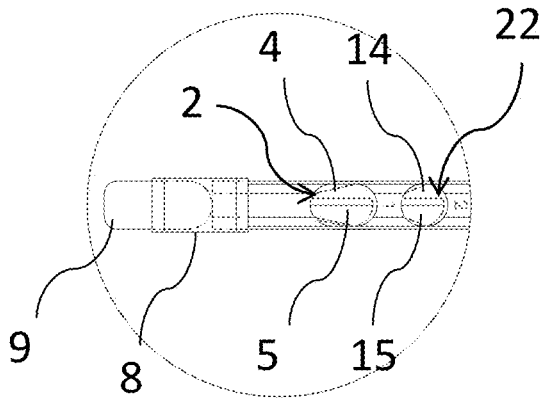
FIG. 7 illustrates a front view of an exemplary writing device that has two sharpeners built therein.
Figure 8:
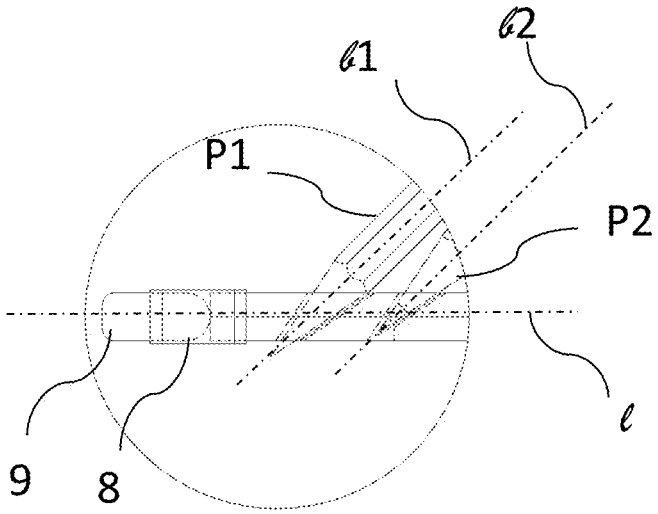
FIG. 8 illustrates a side view of the exemplary writing device that has two sharpeners built therein.

FIGS. 7 and 8 illustrate an exemplary embodiment of the writing device 1 in which the body 3 has a second bore 14 in addition to the first bore 4 formed therein and a pencil P2 being sharpened using a second sharpener 22 built within the body 3 of the writing device 1. Similar to the first bore 4, the second bore 14 is formed in the body 3 at an oblique angle relative to a main axis I of the writing device 1. In other words, the second bore 14 has a bore axis b2 that is oblique to the main axis I of the body 3.

In the illustrated embodiment, the writing device 1 also includes the second sharpener blade 15 operatively attached to the body 3 at least partially within the second bore 14. In the illustrated embodiment, the second bore 14 has a smaller diameter than a diameter of the first bore 4. This way, the sharpener 2 formed by the first bore 4 and the blade 5 may be used to sharpen thicker pencils or the thicker portion of the body of a pencil and the sharpener 22 formed by the bore 14 and the blade 15 may be used to sharpen thinner pencils or just the tip of a pencil.

Figure 9:
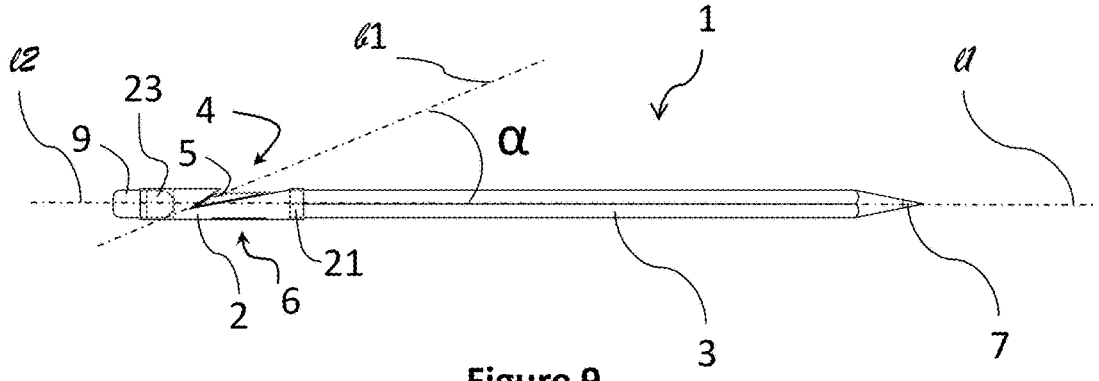
FIG. 9 illustrates a side view of an exemplary pencil sharpener with a pencil releasably attached to the pencil sharpener.
Figure 10:
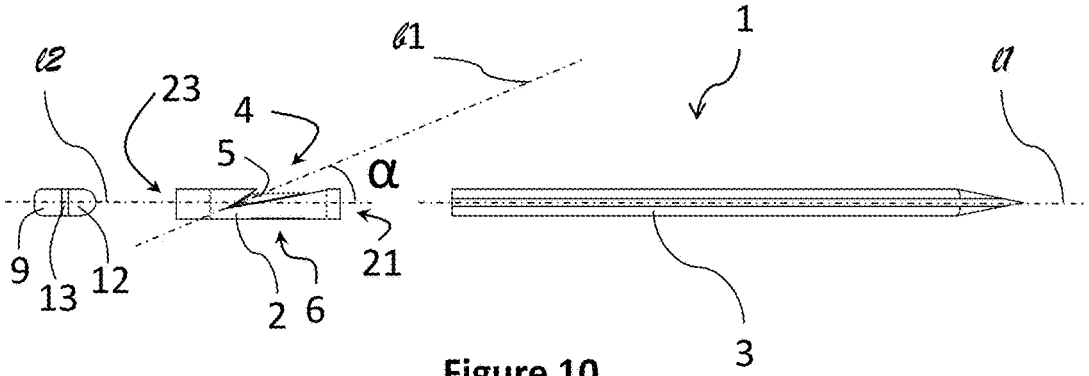
FIG. 10 illustrates the exemplary pencil sharpener with the pencil released from the pencil sharpener.
Figure 11:
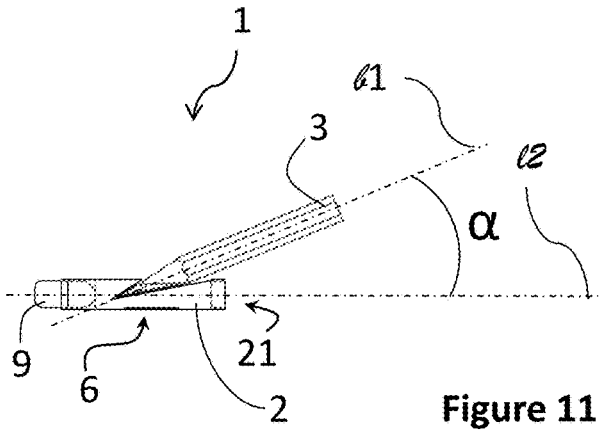
FIG. 11 illustrates a side view of an exemplary pencil sharpener with the pencil released from the pencil sharpener and the pencil being sharpened using the pencil sharpener.

FIGS. 9, 10, and 11 illustrate another exemplary embodiment of the writing device or pencil sharpener assembly 1. The pencil sharpener assembly 1 may include the pencil sharpener or pencil sharpener body 2 and the pencil or pencil body 3 and they may be detachable from each other so that the pencil 3 may be sharpened using the pencil sharpener 2.

To this end, the pencil sharpener 2 includes a pencil receptacle 21 disposed at a first end. As shown in FIG. 9, the pencil receptacle 21 attaches to the pencil 3 with the longitudinal axis I1 of the pencil 3 aligned or parallel to the main axis I2 of the pencil sharpener 2. As shown in FIG. 10, since the pencil receptacle 21 releasably attaches to the pencil 3, the pencil 3 may be released from the pencil receptacle 21. This way, as shown in FIG. 11, the tip of the pencil 3 may be inserted into the pencil sharpener 2 to be sharpened by the sharpener blade 5. In one embodiment, the pencil receptacle 21 releasably attaches to the pencil 3 by interference fit between the pencil receptacle 21 and the pencil 3. In another embodiment, the pencil receptacle 21 includes threads to releasably attach to the pencil 3, which includes matching threads. In other embodiments, the pencil receptacle 21 releasably attaches to the pencil 3 by means other than interference fit or threads.

The pencil sharpener 2 has the bore 4 formed therein. The bore 4 has an axis b1 oblique to the main axis I2 of the pencil sharpener 2. The sharpener blade 5 is disposed adjacent or within the bore 4 such that a portion of the pencil 3 (or another pencil) is insertable into the bore 4 at the angle $\alpha$ oblique to the axis I2 of the pencil sharpener 2 to be sharpened by the sharpener blade 5. The pencil sharpener 2 further includes a groove 6 on a surface of the pencil sharpener 2 that allows sharpener shavings to exit. A user may insert the tip of the pencil 3 into the bore 4 and sharpen the tip by rotating the pencil 3. The sharpener blade 5 shaves the wood and core tip of the pencil 3 while the shavings emerge from the groove 6. The inner surfaces of the bore 4 keep the pencil 3 steady relative to the pencil sharpener 2 while being sharpened.

In one embodiment, the sharpener blade 5 may have the shape illustrated in FIGS. 6A-6C. In another embodiment, the sharpener blade 5 may be a sharpened but otherwise flat piece of metal. The sharpener blade 5 may be separate from or unitary with the rest of the pencil sharpener 2. For example, the pencil sharpener 2 may be fabricated of steel or similar material and the blade 5 may be formed as part of the pencil sharpener 2 or it may be mounted to the pencil sharpener 2.

In the illustrated embodiment and as best shown in the exploded view of FIG. 10, the pencil sharpener 2 may also include a second receptacle 23 disposed at the opposite end from the pencil receptacle 21. The second receptacle 23 may receive the eraser 9. This way, the eraser 9 may be attached to pencil sharpener 2.

As described above, the pencil 3 may include an electrically conductive layer (e.g., sprayed on metal, film, etc.) that coats at least some of their exterior. The pencil sharpener 2 may also be electrically conductive. In one embodiment, the solid pigment core 7 may also be electrically conductive (e.g., metal-infused graphite, etc.) and may be electrically or capacitively connected to the pencil sharpener 2. The solid pigment core 7 may be electrically or capacitively connected to the electrically conductive layer and/or the pencil sharpener 2 via a metallic connection. In one embodiment, the pencil sharpener 2 includes an electrically conductive elastomeric dome 12. The second receptacle 23 may receive the dome 12 to attach it to the pencil sharpener 2. The dome 12 may be electrically or capacitively connected to the pencil sharpener 2 and/or the electrically conductive layer. Thus, the pencil sharpener 2 may be used as a thin or a thick stylus depending on the user's needs.

In the illustrated embodiment of FIGS. 9, 10, and 11, the pencil sharpener 2 includes both the eraser 9 and the dome 12. In such an embodiment, the pencil sharpener 2 may include a magnet 13 attached to each of the eraser 9 and the dome 12. The pencil sharpener 2 (or at least the second receptacle 23) may be made of a magnetic material such that the assembly formed by the eraser 9, the dome 12 and the magnet 13 may be retained within the second receptacle 23 by the magnetic connection. A user may pull the assembly formed by the eraser 9, the dome 12 and the magnet 13 from the second receptacle 23 by breaking the magnetic force. This way, the user may reversibly choose whether to use the eraser 9 or the dome 12. In this embodiment, the electrical or capacitive connection between the dome 12 and the pencil sharpener 2 may be provided through the magnet 13.

While example systems, methods, and so on, have been illustrated by describing examples, and while the examples have been described in considerable detail, it is not the intention to restrict or in any way limit the scope of the appended claims to such detail. It is, of course, not possible to describe every conceivable combination of components or methodologies for purposes of describing the systems, methods, and so on, described herein. Additional advantages and modifications will readily appear to those skilled in the art. Therefore, the invention is not limited to the specific details, and illustrative examples shown or described. Thus, this application is intended to embrace alterations, modifications, and variations that fall within the scope of the appended claims. Furthermore, the preceding description is not meant to limit the scope of the invention. Rather, the scope of the invention is to be determined by the appended claims and their equivalents.

To the extent that the term "includes" or "including" is employed in the detailed description or the claims, it is intended to be inclusive in a manner similar to the term "comprising" as that term is interpreted when employed as a transitional word in a claim. Furthermore, to the extent that the term "or" is employed in the detailed description or claims (e.g., A or B) it is intended to mean "A or B or both". When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (3D. Ed. 1995).

What is claimed is:

1. A pencil sharpener comprising:

a body having a first end and a second end aligned along a main axis of the body, the body having a pencil receptacle disposed at the first end and configured to releasably attach to a pencil having an outer periphery and a longitudinal axis within the outer periphery of the pencil, the body further having a bore formed therein between the first end and the second end and intersecting the longitudinal axis of the pencil, the bore having a bore axis oblique to the main axis; and a sharpener blade disposed adjacent the bore such that a portion of a pencil is insertable into the bore of the body to be sharpened by the sharpener blade.

2. The pencil sharpener of claim 1, wherein a groove is arranged on a surface of the pencil sharpener, the groove allows shavings of the pencil being sharpened to exit the bore.

3. The pencil sharpener of claim 1, wherein a groove is arranged on a surface of the pencil sharpener;

the sharpener blade having a shape of a modified oblique cone from one end of which two arms extend rearward away from a vertex of the modified oblique cone and in parallel to each other with a space in between, the groove being configured to allow pencil shavings to exit the bore, one of the two arms has a blade with a flat surface, the flat surface having a sharpening edge capable of removing wood and refining a lead of the pencil, and the other arm is configured to guide sharpening of the pencil and maintain stability when the pencil is being sharpened.

4. The pencil sharpener of claim 1, comprising:

an electrically conductive layer coating at least some of an exterior of the body.

5. The pencil sharpener of claim 1, comprising:

an electrically conductive layer coating at least some of an exterior of the body, wherein the body has a second receptacle disposed at the second end and configured to attach to an electrically conductive elastomeric dome to be electrically or capacitively connected to the electrically conductive layer.

6. The pencil sharpener of claim 1, comprising:

a second receptacle disposed at the second end and configured to attach an eraser at the second end.

7. The pencil sharpener of claim 1, comprising:

a second receptacle disposed at the second end; and a reversible assembly that includes an electrically conductive elastomeric dome at one end and an eraser at the other end, the reversible assembly being reversibly installable to the second receptacle such that, in a first configuration, the electrically conductive elastomeric dome is disposed at the second end of the pencil sharpener and, in a second configuration, the eraser is disposed at the second end of the pencil sharpener.

8. The pencil sharpener of claim 1, wherein the pencil receptacle releasably attaches to the pencil by interference fit between the pencil receptacle and the pencil.

9. The pencil sharpener of claim 1, wherein the pencil receptacle includes threads to releasably attach to the pencil.

10. A pencil sharpener assembly, comprising:

the pencil sharpener of claim 1, and a pencil releasably attached to the pencil receptacle.

11. A pencil sharpener assembly, comprising:

an outer periphery and pencil having a longitudinal axis with the outer periphery; and a pencil sharpener body having a first end and a second end aligned along a main axis of the pencil sharpener body, the pencil sharpener body further having a bore formed therein between the first end and the second end and intersecting the longitudinal axis of the pencil, the bore having a bore axis oblique to the main axis; and a sharpener blade disposed adjacent the bore, wherein the pencil sharpener body has a pencil receptacle disposed at the first end and configured to releasably attach to the pencil such that, in a first configuration, the pencil releasably attaches to the pencil receptacle with the longitudinal axis of the pencil parallel to the main axis of the pencil sharpener body and, in a second configuration, the pencil released from the pencil receptacle is partially insertable into the bore of the pencil sharpener body to be sharpened by the sharpener blade.

12. The pencil sharpener assembly of claim 11, wherein a groove is arranged on a surface of the pencil sharpener body, the groove allows shavings of the pencil being sharpened to exit the bore.

13. The pencil sharpener assembly of claim 11, wherein a groove is arranged on a surface of the pencil sharpener body;

the sharpener blade having a shape of a modified oblique cone from one end of which two arms extend rearward away from a vertex of the modified oblique cone and in parallel to each other with a space in between, the groove being configured to allow pencil shavings to exit the bore, one of the two arms has a blade with a flat surface, the flat surface having a sharpening edge capable of removing wood and refining a lead of the pencil, and the other arm is configured to guide sharpening of the pencil and maintain stability when the pencil is being sharpened.

14. The pencil sharpener assembly of claim 11, comprising:

an electrically conductive layer coating at least some of an exterior of the pencil sharpener body.

15. The pencil sharpener assembly of claim 11, comprising:

an electrically conductive layer coating at least some of an exterior of the pencil sharpener body, wherein the pencil sharpener body has a second receptacle disposed at the second end and configured to attach to an electrically conductive elastomeric dome to be electrically or capacitively connected to the electrically conductive layer.

16. The pencil sharpener assembly of claim 11, comprising:

a second receptacle disposed at the second end and configured to attach an eraser at the second end.

17. The pencil sharpener assembly of claim 11, comprising:

a second receptacle disposed at the second end; and a reversible assembly that includes an electrically conductive elastomeric dome at one end and an eraser at the other end, the reversible assembly being reversibly installable to the second receptacle such that, in a first configuration, the electrically conductive elastomeric dome is disposed at the second end of the pencil sharpener and, in a second configuration, the eraser is disposed at the second end of the pencil sharpener.

18. The pencil sharpener assembly of claim 11, wherein the pencil receptacle releasably attaches to the pencil by interference fit between the pencil receptacle and the pencil.

19. The pencil sharpener assembly of claim 11, wherein the pencil receptacle includes threads to releasably attach to the pencil.

20. A pencil sharpener assembly, comprising:

a pencil sharpener body having a first end and a second end aligned along a main axis of the pencil sharpener body, the pencil sharpener body further having a bore formed therein between the first end and the second end, the bore having a bore axis oblique to the main axis; and a sharpener blade disposed adjacent the bore, wherein the pencil sharpener body has a pencil receptacle disposed at the first end and configured to releasably attach to a first pencil having an outer periphery with a longitudinal axis within the outer periphery wherein the bore intersects the longitudinal axis of the pencil parallel to the main axis of the pencil sharpener body and a second pencil or the first pencil released from the pencil receptacle is partially insertable into the bore of the pencil sharpener body to be sharpened by the sharpener blade.

* * * * *